US010683697B2

(12) United States Patent
Clauson et al.

(10) Patent No.: US 10,683,697 B2
(45) Date of Patent: Jun. 16, 2020

(54) FIRE-RATED SLIDING GLASS ELEVATOR DOOR

(71) Applicant: EP Acquisition, Inc., Brooklyn Park, MN (US)

(72) Inventors: Julie Ann Clauson, New Brighton, MN (US); Jashan Deshan Eison, Brooklyn Park, MN (US); Mark Gabriel Hamilton, Roseville, MN (US); Chad Joseph Norberg, Emerald, WI (US); William Theodore Sillman, Saint Paul, MN (US); Leo Joseph Tomperi, Brooklyn Park, MN (US)

(73) Assignee: EP Acquisition, Inc., Brooklyn Park, MN (US)

( * ) Notice: Subject to any disclaimer, the term of this patent is extended or adjusted under 35 U.S.C. 154(b) by 0 days.

(21) Appl. No.: 16/434,347

(22) Filed: Jun. 7, 2019

(65) Prior Publication Data

US 2019/0376335 A1 Dec. 12, 2019

Related U.S. Application Data

(60) Provisional application No. 62/682,573, filed on Jun. 8, 2018.

(51) Int. Cl.

| | |
|---|---|
| ***E06B 5/16*** | (2006.01) |
| ***E04B 1/94*** | (2006.01) |
| ***E06B 3/02*** | (2006.01) |
| ***B66B 13/30*** | (2006.01) |

(52) U.S. Cl.

CPC ..... *E06B 5/162* (2013.01); *B66B 13/303* (2013.01); *E04B 1/941* (2013.01); *E06B 3/02* (2013.01); *E05Y 2900/104* (2013.01)

(58) Field of Classification Search

CPC ..... E06B 5/162; E06B 3/02; B66B 13/303; B66B 13/08; E04B 1/941; E05Y 2900/104

USPC ..... 52/784.11, 208, 455, 204.62

See application file for complete search history.

(56) References Cited

U.S. PATENT DOCUMENTS

| | | | | |
|---|---|---|---|---|
| 1,770,267 A | | 7/1930 | Joseph | |
| 5,139,111 A | | 8/1992 | Baumann et al. | |
| 5,156,237 A | * | 10/1992 | Hayashi | B66B 13/08 187/333 |

(Continued)

FOREIGN PATENT DOCUMENTS

| | | |
|---|---|---|
| EP | 2239223 | 10/2010 |

OTHER PUBLICATIONS

"3M Aluminum Foil Tape 425-427," Technical Data 3M Industrial Adhesives and Tapes Division Jun. 2015 (2 pages).

(Continued)

*Primary Examiner* — Brian D Mattei

(74) *Attorney, Agent, or Firm* — Pauly, DeVries Smith & Deffner LLC

(57) ABSTRACT

A fire-rated sliding elevator glass door is provided. The door includes a face panel, a liner, a fire-rated glass panel, and a retainer that retains the glass panel in the door frame. The elevator door is configured to pass a 90-minute fire rating test. The elevator door can be implemented as a single-speed side open elevator door, a single-speed center open elevator door, a two-speed side opening sliding elevator door, or a two-speed center opening sliding elevator door. A method of constructing the fire-rated elevator door is provided.

20 Claims, 6 Drawing Sheets

(56) References Cited

U.S. PATENT DOCUMENTS

| | | | | |
|---|---|---|---|---|
| 5,293,962 | A * | 3/1994 | Pelvilain | E06B 5/16 187/333 |
| 7,152,906 | B1 * | 12/2006 | Farrar | B60J 1/007 296/146.15 |
| 8,869,474 | B2 | 10/2014 | Yoon | |
| 9,567,191 | B2 | 2/2017 | Fried et al. | |
| 9,650,230 | B2 | 5/2017 | Ketonen | |
| 2001/0023560 | A1 * | 9/2001 | Degelsegger | E06B 3/025 52/204.1 |
| 2003/0188498 | A1 * | 10/2003 | Lewkowitz | E06B 3/5892 52/208 |
| 2010/0180507 | A1 * | 7/2010 | Puchebner | B61D 19/02 49/226 |
| 2011/0132698 | A1 * | 6/2011 | Yu | B66B 13/30 187/333 |
| 2014/0008156 | A1 * | 1/2014 | Umbaugh | B66B 13/301 187/313 |
| 2014/0246276 | A1 * | 9/2014 | Ketonen | B66B 13/30 187/336 |
| 2017/0044811 | A1 * | 2/2017 | Tsou | E06B 3/70 |
| 2019/0010017 | A1 * | 1/2019 | Coldre | B66B 3/002 |
| 2019/0177128 | A1 * | 6/2019 | Ruan | B66B 13/08 |
| 2019/0292843 | A1 * | 9/2019 | Torrabias Cantal | E06B 3/67 |

OTHER PUBLICATIONS

"Anti-vandal doors," EN81-71 Category I, Wittur product descriptions (2 pages).

"Fire-tested landing doors according to EN81-58," Lift-Report 39 Jahrg. (2013) p. 90 (1 page).

"Landing doors compliant with DIN 18 091 and DIN EN 81 Part 58 with identical measurement specifications," Lift-Report 39. Jahrg. (2013) pp. 118-120 (3 pages).

"Pemko FB3000 Fire Glazing Tape," Architectural Door Accessories Pemko Manufacturing Co., an ASSA ABLOY Group Company 2017 (2 pages).

"Resistance to Fire Classification Report for Product FIRES-CR-165-07-NURE," FIRES-CR-165-07-NURE, 2005 (40 pages).

* cited by examiner

FIRE-RATED SLIDING GLASS ELEVATOR DOOR

This application claims the benefit of U.S. Provisional Application No. 62/682,573, filed Jun. 8, 2018, the content of which is herein incorporated by reference in its entirety.

BACKGROUND

Building codes require builders to make elevators that meet particular safety standards. One such standard is fire rating. A fire rating indicates the amount of time that a particular item can withstand a fire with particular characteristics. For example, an elevator door with a 90-minute fire rating must be tested by being exposed to fire for at least 90 minutes. To pass the rating test, the fire must not spread beyond the elevator door in that 90 minutes. This test is rigorous, and difficult to pass. Previously, glass elevators were unable to pass a 90 minute fire-rating test because the materials, including the glass, could not withstand a 90 minute fire.

One aspect of the fire-rating test is a hose stream test, which tests the strength of the door by spraying water from a fire hose at the door under high pressure. The hose stream test is administered immediately after or within 3 minutes of the 90 minute fire endurance test. Water is sprayed onto the doors from 20 feet away using a 2.5" hose with a 1⅛" tip at 30 PSI (pounds per square inch) minimum, subjecting the doors to impact, erosion, and thermal shock.

SUMMARY

A fire-rated sliding glass elevator door is provided. In some examples of the technology, an elevator hoistway door includes a face panel framing a void and a liner framing a void, where the face panel and the liner define a door core thickness. The door includes a fire-rated glass panel having a thickness that is greater than the door core thickness. The glass panel has a hoistway-facing surface and a corridor-facing surface. The door includes one or more retainers secured to the hoistway-facing surface of the glass panel and to a hoistway-facing surface of the liner.

In some examples, the elevator door can have one or more retainers that each have an elongated member with a central elongate portion having a first elongate perpendicular extension from a first end of the central elongate portion and a second elongate perpendicular extension from a second end of the central elongate portion. In some examples, a corridor-facing surface of the glass panel is bonded to a hoistway-facing surface of the face panel with a bonding tape. In some examples, the glass panel has at least a 90-minute fire rating. In some examples, the glass panel sits proud of the liner on a hoistway-facing side of the elevator door. In some examples, the liner void is larger than the face panel void. Some examples of the elevator door include a retainer clip attached to a vertical portion of the elevator door. In some examples, the retainers are bonded to the hoistway-facing surface of the glass panel with a double-sided bonding tape. In some examples, the retainers are fixed to the liner with a fastener. In some examples, the door also has one or more setting blocks around an outside perimeter of the glass panel. In some examples, the setting blocks comprise a non-combustible material. In some examples, the setting blocks are made of calcium silicate or fiberglass, which are non-combustible. In some examples, the setting blocks comprise wood. In some examples, the door is a single-speed side opening door. In some examples, the door is a single-speed center opening door. In some examples, the door comprises a single panel construction. In some examples, the door comprises a multi-panel construction. In some examples, the door is a two-speed side opening door. In some examples, the door is a two-speed center opening door. In some examples, elevator door has two horizontal retainers and two vertical retainers. In some examples, there is no air gap in a glass portion of the door.

Other examples of the disclosed technology provide a method of constructing a fire-rated elevator door that has a face panel framing a void, a liner framing a void, a fire-rated glass panel, and one or more retainers. The method includes aligning the face panel void with the liner void to form a door frame, fastening the face panel to the liner, and applying a first bonding tape to either a hoistway-facing surface of the face panel or to a corridor-facing surface of the glass panel. After the step of applying the first bonding tape, the method further includes inserting the glass panel through the liner void and into an interior of the door frame, bonding the hoistway-facing surface of the face panel to the corridor-facing surface of the glass panel such that the glass panel protrudes beyond a hoistway-facing side of a door core of the elevator door. The method also includes applying a second bonding tape to a hoistway-facing surface of the glass panel or to a glass-facing surface of a retainer and bonding the hoistway-facing surface of the glass panel to the glass-facing surface of the retainer. The method further includes fastening a liner-facing surface of the retainer to a hoistway-facing surface of the liner.

Some examples of the disclosed method also include inserting a spacing assembly between the face panel and the liner, and inserting a plurality of setting blocks around an outside perimeter of the glass panel between the glass panel and the spacing assembly. In some examples, the face panel and liner are fastened by welding with welds spaced no more than 6 inches apart. In some examples, the retainer and liner are fastened with a plurality of fasteners spaced no more than 6 inches apart. In some examples, the retainer is fixed to the liner with a plurality of fasteners.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense.

Except where indicated, the figures are not necessarily drawn to scale. While examples of the disclosed technology can be implemented with various modifications and alternative forms, some specifics of the technology are shown by way of example in the specification and drawings. It should be understood, however, that the scope of the disclosed technology is not limited to the particular examples described. On the contrary, the intention is to cover modifications, equivalents, and alternatives falling within the spirit and scope of the present disclosure.

DETAILED DESCRIPTION

The disclosed technology provides a horizontal sliding glass elevator door that can withstand at least a 90 minute fire, as evidenced, for example, by being tested and passing the test for UL 10B, "UL Standard for Safety for Fire Tests of Door Assemblies," Underwriters Laboratories (UL) LLC, Tenth Edition (2008). The door includes a steel construction frame with dimensions to allow for fire-rated glass panels of various sizes. In some examples, the technology includes a fire-rated laminated glass panel consisting of alternating layers of glass and intumescent material. The door core thickness of the elevator door can be similar to traditional metal door cores even if the glass panel thickness is larger than the thickness of a traditional door core. This allows the technology to be used in remodeling old construction as well as building new constructions. Additionally, the current door design, which includes an interlocking face panel, liner, and retainers, provides the necessary strength to withstand all of the stresses administered during the hose stream test.

More particularly, a fire-rated glass panel can be held in place in the elevator hoistway door by one or more retainers. In some examples, the retainers are located on the side of the elevator door that faces the hoistway. In some examples, the door is also designed to allow for decorative claddings to be applied while still meeting elevator code.

Figure 1:
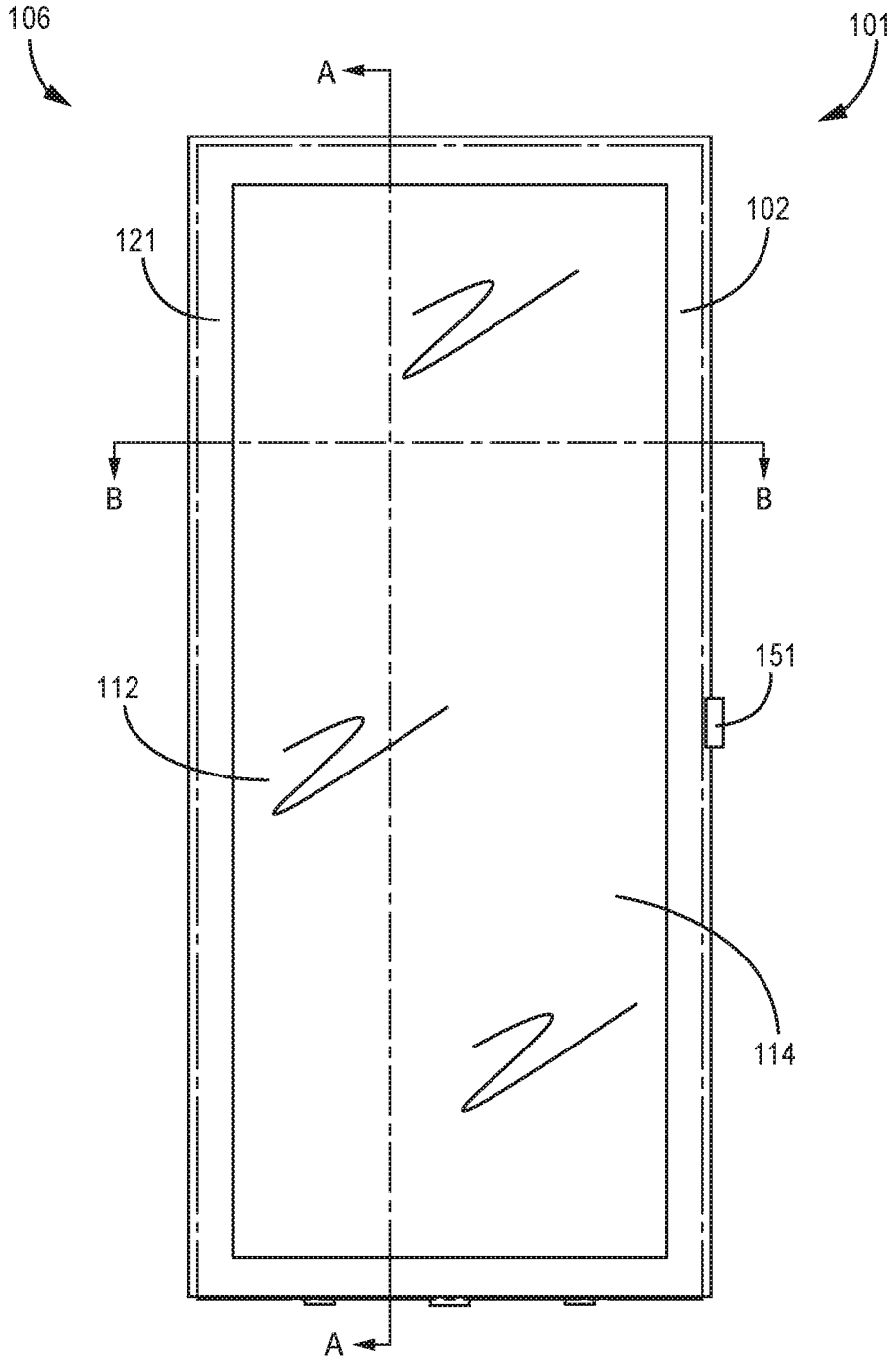
FIG. 1 is a front elevational view of an elevator hoistway door according to some examples.

Turning to the drawings, FIG. 1 is a front elevational view of an elevator hoistway door according to some examples. FIG. 1 shows an elevator hoistway door 101. The elevator door 101 can be a single-speed side opening door. In alternative examples, the elevator door 101 can be a single-speed center opening door. The disclosed technology could also be implemented with a two-speed side opening sliding elevator door or a two-speed center opening sliding elevator door. The elevator door 101 is shown from the viewpoint of a corridor-facing side 106; that is, the side of the door that faces a corridor or hallway. The door 101 has a frame 121 that is defined partially by a face panel 102. A fire-rated glass panel 112 sits inside of the frame 121. The glass panel 112 includes a corridor-facing surface 114 that faces the corridor. A retainer clip 151 is attached to a vertical portion of the frame 121. The retainer clip 151 helps to prevent the face panel 102 from pulling away from the frame 121. The glass panel 112 has at least a 90-minute fire rating. For example, the glass panel can be Pilkington Pyrostop® 90 minute fire-rated glass, which is a clear, laminated, fully insulating fire-rated safety glass manufactured by Technical Glass Products of Snoqualmie, Wash. A fire rating is received when the glass has successfully passed industry standard tests in accordance with one or more standards that include: UL 9 ("Standard for Fire Tests of Window Assemblies," Underwriters Laboratories (UL) LLC), UL 10B ("Standard for Fire Tests of Door Assemblies", UL LLC), UL 10C ("Standard for Positive Pressure Fire Tests of Door Assemblies", UL LLC), UL 263 ("Standard for Fire Tests of Building Construction and Materials", UL LLC), ASTM E-119 ("Standard Test Methods for Fire Tests of Building Construction and Materials", ASTM International), CAN/ULC-S101 ("Standard Methods of Fire Endurance Tests of Building Construction and Materials", UL LLC), CAN4 S-104 ("Standard Method for Fire Tests of Door Assemblies", UL LLC), CAN4 S-106 ("Standard Method For Fire Tests Of Window And Glass Block Assemblies"), NFPA 80 ("Standard for Fire Doors and Other Opening Protectives," National Fire Protection Association (NFPA)), NFPA 251 ("Standard Methods of Tests of Fire Resistance of Building Construction and Materials", National Fire Protection Association (NFPA)), NFPA 252 ("Standard Methods of Fire Tests of Door Assemblies", National Fire Protection Association (NFPA)), and NFPA 257 ("Standard on Fire Test for Window and Glass Block Assemblies", National Fire Protection Association (NFPA)).

Figure 2:
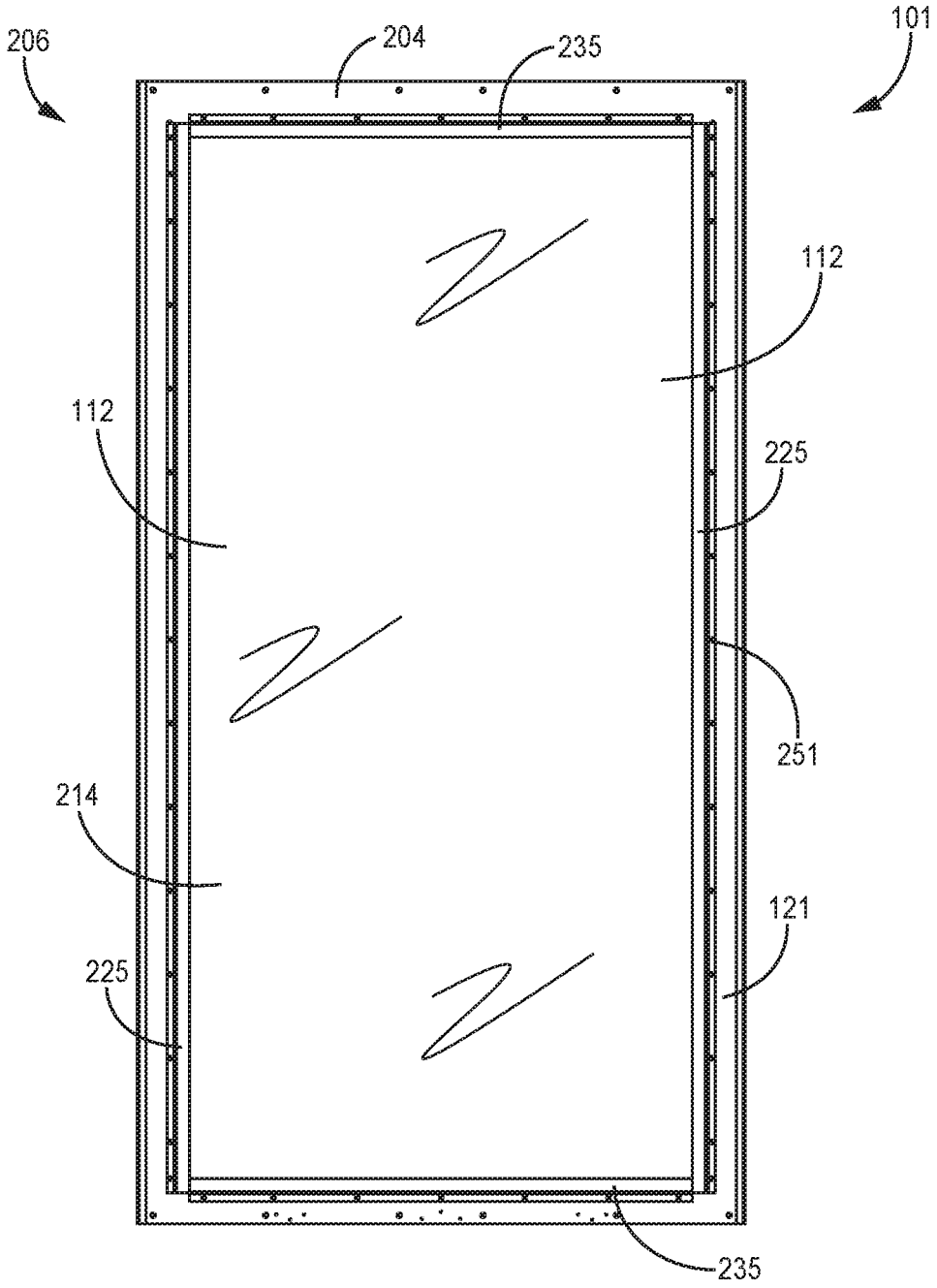
FIG. 2 is a rear elevational view of the elevator hoistway door of FIG. 1 according to some examples.

FIG. 2 is a rear elevational view of the elevator door 101 of FIG. 1. FIG. 2 shows the hoistway-facing side 206 of the elevator door 101. The hoistway, also called a shaft, is where an elevator cab travels between floors. In normal use, the hoistway-facing side 206 of the elevator door 101 is not seen by passengers of the elevator because it is obscured by a cab door (the elevator cab and cab door are not shown). The frame 121 further includes a liner 204 that surrounds the glass panel 112. FIG. 2 shows the glass panel 112 with a hoistway-facing surface 214. As will be discussed later, the elevator door 101 includes one or more retainers that hold the glass panel 112 inside of the frame 121. In the example of FIG. 2, the elevator door 101 has two vertical retainers 225 and two horizontal retainers 235 that enclose the edge of the glass panel 112. In some examples, the retainers 225, 235 are affixed to the frame 121 with fasteners 251. In some examples, the fasteners 251 can include a screw. In alternative examples, the fasteners 251 could include a nut and bolt, a weld, or other such fastening mechanisms.

Figure 3:
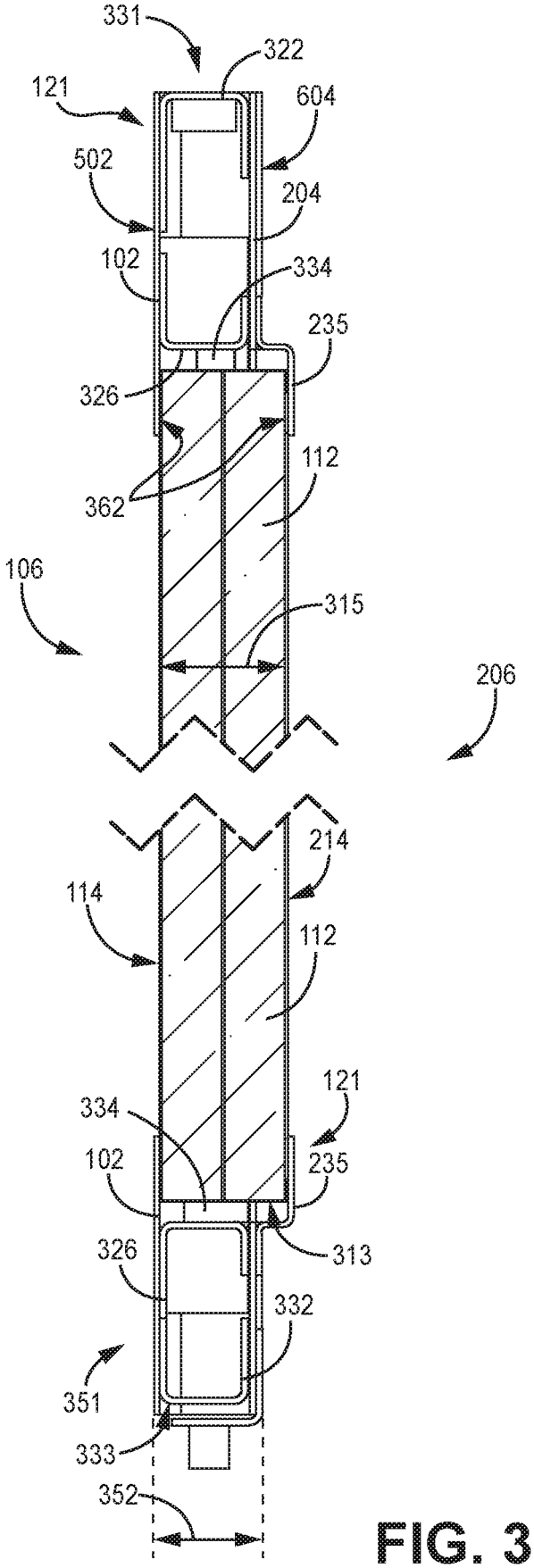
FIG. 3 is a cross-sectional view of the elevator hoistway door of FIG. 1 taken along line A-A.

A portion of the internal structure of the elevator door 101 can be seen in FIG. 3, which is a cross-sectional view of the elevator hoistway door of FIG. 1 taken along line A-A. The frame 121 includes the face panel 102, the liner 204, and horizontal retainers 235. A top spacing assembly 331, comprising a top channel 322 and a horizontal rib 326, provides structure to reinforce the frame 121. Similarly, a bottom spacing assembly 333, comprising a bottom channel 332 and a second horizontal rib 326, provides structure to reinforce a bottom portion of the frame 121. The frame 121 includes a door core 351 bounded by the face panel 102 and the liner 204.

The door core 351 has a door core thickness 352, which is defined herein as the distance between the corridor-facing surface 502 of the face panel 102 and the hoistway-facing surface 604 of the liner 204. More particularly, the door core 351 can have a standardized thickness that is used in many elevator doors.

Traditional door cores are metal and can be pan style or sandwich style. Pan style elevator doors have one face sheet, and sandwich style elevator doors have a face sheet and a liner. In either case, each door core has reinforcing properties to allow it to pass ASME A17.1 requirements ("Safety Code for Elevators and Escalators", ASME International). Door core thicknesses can vary based on the design of the entrance. Door core thickness dimensions may be between about 1.25 inches and 3.5 inches, between about 1.25 inches and 5 inches, and between about 1.25 inches and 4.25 inches.

The glass panel 112 has a thickness 315 defined between a hoistway-facing surface 214 and a corridor-facing surface 114 of the glass panel 112. The glass panel thickness 315 can be, for example 1 and 7/16 inches (1.4375 inches, or approximately 3.65 cm). The glass panel may be made of multiple layers of glass with layers of intumescent material between the layers of glass. Intumescent material can also be provided around the outside perimeter 313 of the glass panel 112. The fire rating of the safety glass is dependent upon the thickness of the glass. In some examples, a safety glass with a thickness of greater than about 1.25 inches is required to withstand a 90 minute fire rating. In some examples, a thickness of 1 and 7/16 inch is required. A fire rating of greater than 90 minutes, such as a 120 minute fire rating, will require an even thicker glass. The safety glass itself does not contain any air gaps, because the safety glass uses layers of intumescent material that expands when exposed to intense heat.

Around the glass panel 112, between the outside perimeter 313 of the glass panel 112 and the spacing assemblies 331, 333, multiple setting blocks 334 are positioned. The setting blocks 334 provide spacing between the glass panel 112 and the inside of the frame 121. In some examples, the setting blocks 334 can be constructed from a solid material. For example, the setting blocks 334 can be made of a hardwood such as oak. In some examples, the setting blocks are made of a non-combustible material such as calcium silicate or fiberglass.

The glass panel thickness 315 is necessitated by the fire rating of the elevator door 101. Therefore, in some cases, glass panel 112 has a thickness 315 that is greater than the door core thickness 352. In some examples, including that of FIG. 3, the door core thickness 352 is smaller than the glass panel thickness 315. In some examples, the glass panel 112 sits proud of the liner 204 on the hoistway-facing side 206 of the elevator door 101.

In some examples of the disclosed technology, the glass panel 112 is held in place within the frame 121 by a bonding tape 362. As demonstrated in the examples of FIGS. 3 and 4, a corridor-facing surface 114 of the glass panel 112 is bonded to a hoistway-facing surface 504 of the face panel 102 with a bonding tape 362. In some examples, the retainers 225, 235 are bonded to the hoistway-facing surface 214 of the glass panel 112 with a bonding tape 362. For example, the bonding tape 362 can be a VHB (very high bond) double-sided tape, such as that made by 3M Company of St. Paul, Minn. The bonding tape provides some protection to the surface of the glass, and it separates the metal of the frame 121 from the glass surfaces. The bonding tape 362 may also be an aluminized tape made by 3M Company of St. Paul, Minn., KERAFIX® ceramic tape available from CHM Limited of Lancaster, England, PEMKO® adhesive glazing tape available from ASSA ABLOY of Memphis, Tenn., METACAULK® BLAZESEAL® tape available from Rectorseal of Houston, Tex., FIBERFRAX® cloth tape available from Unifrax of Tonawanda, N.Y., or NORSEAL® PVC Foam-Glazing Tape available from Saint-Gobain of North America, or a combination of these options.

Figure 4:
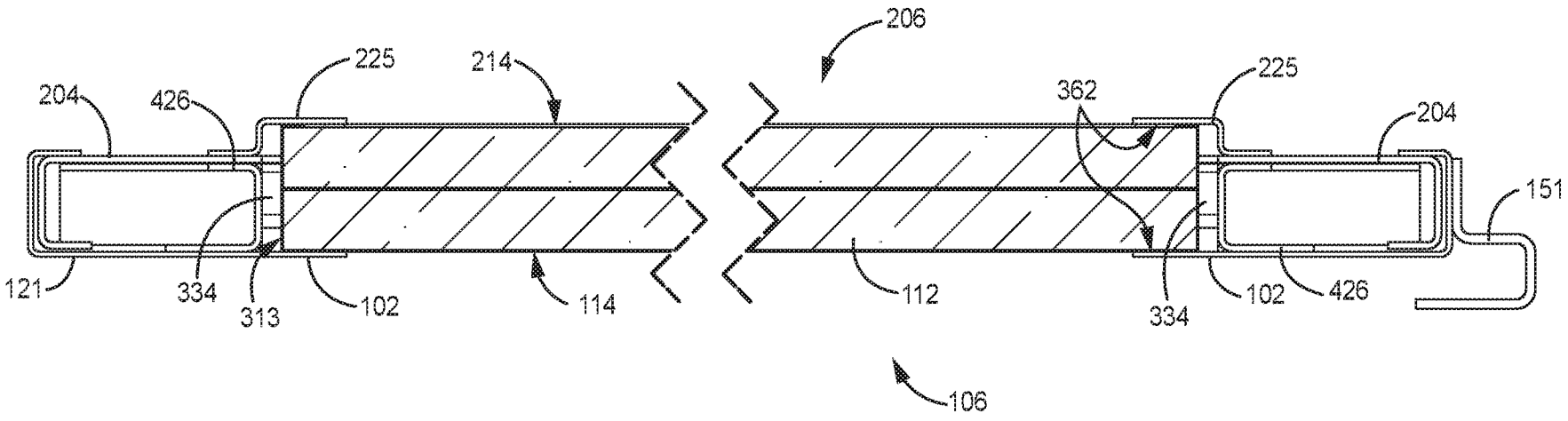
FIG. 4 is a cross-sectional view of the elevator hoistway door of FIG. 1 taken along line B-B.

FIG. 4 is a cross-sectional view of the elevator hoistway door of FIG. 1 taken along line B-B. The frame 121 includes the face panel 102, the liner 204, and vertical retainers 225. The outside perimeter 313 of the glass panel 112 is set apart from a spacing assembly 426 of the frame 121 by multiple setting blocks 334.

The retainers 225, 235 are secured to the hoistway-facing surface 214 of the glass panel 112 and to a hoistway-facing surface 604 of the liner 204. In the example of the FIGS. 3 and 4, the liner 204 is not bonded to the glass panel 112. Instead, a retainer 225 is fastened to the liner 204, and then the retainer 225 is affixed to the surface of the glass panel 112.

Figure 5A:
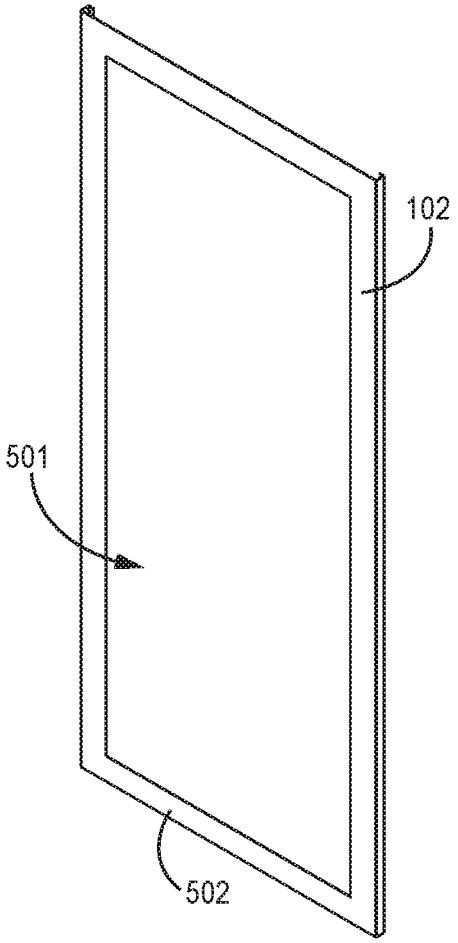
FIG. 5A is a perspective view of a face panel for an elevator hoistway door according to some examples.
Figure 5B:
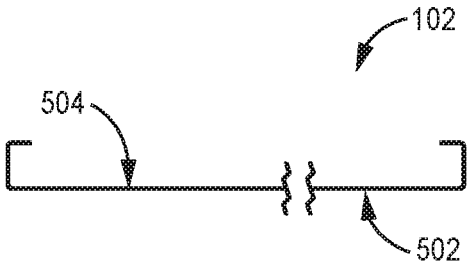
FIG. 5B is a top view of the face panel of FIG. 5A according to some examples.

FIG. 5A is a perspective view of a face panel for an elevator hoistway door according to some examples, and FIG. 5B is a top view of the face panel of FIG. 5A. The face panel 102 frames a cutout or void 501. The face panel 102 has a hoistway-facing surface 504 and a corridor-facing surface 502.

In some examples, the face panel can be constructed from a metal, such as carbon steel. This would include, for example, stainless steel or cold rolled steel. In some examples, the face panel can be made with 16 gauge cold rolled steel. The face panel 102 can have a height between about 80 inches and about 100 inches. The face panel 102 can have a width between about 24 inches and about 50 inches. The void 501 can have a height of between about 70 inches and about 90 inches. The void 501 can have a width of between about 20 inches and about 40 inches.

Figure 6A:
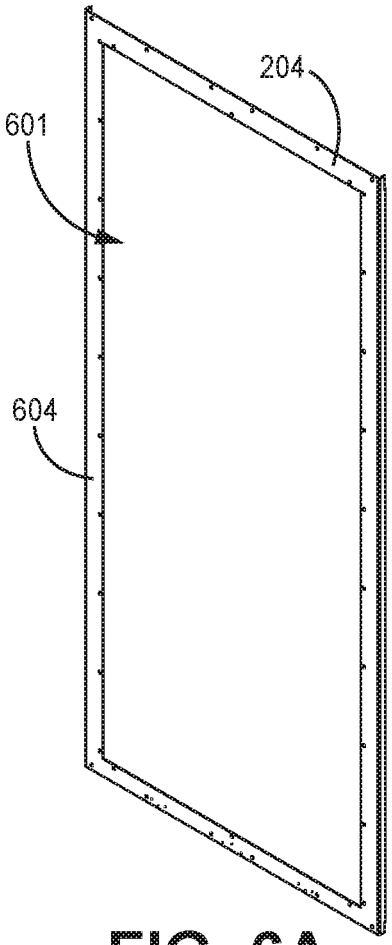
FIG. 6A is a perspective view of a liner for an elevator hoistway door according to some examples.
Figure 6B:
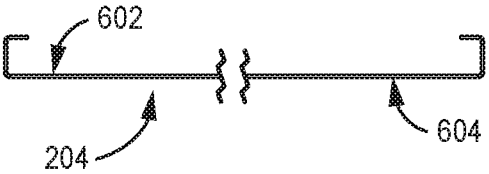
FIG. 6B is a top view of the liner of FIG. 6A according to some examples.

FIG. 6A is a perspective view of a liner for an elevator hoistway door according to some examples, and FIG. 6B is a top view of the liner of FIG. 6A. The liner 204 frames a cutout or void 601. The liner void 601 is larger than the face panel void 501, to accommodate the glass panel 112. The liner 204 has a hoistway-facing surface 604 and a corridor-facing surface 602. In some examples, the liner can be constructed from a metal, such as carbon steel. This would include, for example, stainless steel or cold rolled steel. In some examples, the liner can be made with 14 gauge cold rolled steel. The liner 204 can have a height of between about 80 inches and about 100 inches. The liner 204 can have a width between about 24 inches and about 50 inches. The void 601 can have a height of between about 70 inches and about 90 inches. The void 601 can have a width of between about 18 inches and about 40 inches.

The retainers 225, 235 are secured to the hoistway-facing surface 214 of the glass panel 112 and to a hoistway-facing surface 604 of the liner 204. In the example of the FIGS. 3 and 4, the liner 204 is not bonded to the glass panel 112. Instead, a retainer 225 is fastened to the liner 204, and then the retainer 225 is affixed to the surface of the glass panel 112.

Figure 7A:
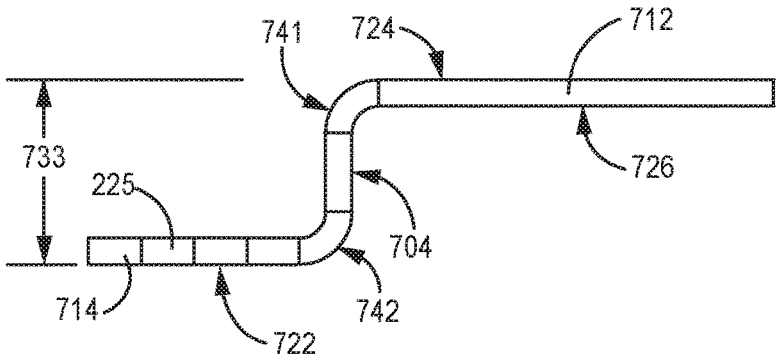
FIG. 7A is a cross-sectional view of a retainer for an elevator hoistway door according to some examples.
Figure 7B:
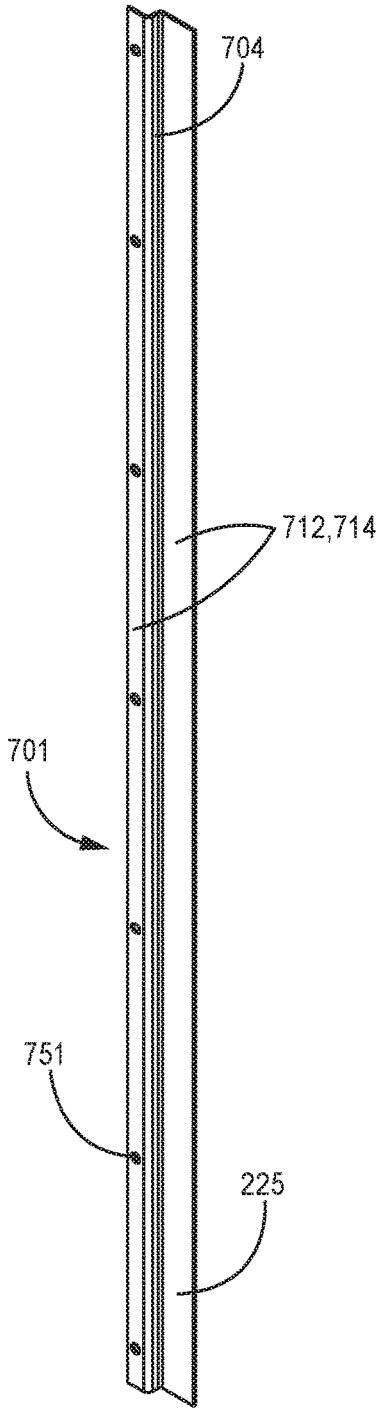
FIG. 7B is a perspective view of the retainer of FIG. 7A.

FIG. 7A is a cross-sectional view of a retainer for an elevator hoistway door according to some examples, and FIG. 7B is a perspective view of the retainer of FIG. 7A. The retainer 225 is shown in FIGS. 7A and 7B, and the retainer 235 contains similar structures. The retainer is situated in the frame 121 such that the retainer 225 protrudes away from the door core. This allows the glass panel to sit proud of the door core 351.

The retainer 225 is an elongated member 701 with a central elongate portion 704 having a first elongate perpendicular extension 712 from a first end 741 of the central elongate portion 704 and a second elongate perpendicular extension 714 from a second end 742 of the central elongate portion 704. The retainer 225 has a hoistway-facing surface 724, a glass-facing surface 726, and a liner-facing surface 722. Optionally, one of the elongate perpendicular extensions has multiple holes 751 for the fasteners 251. The retainer 225 can be constructed from a metal, such as carbon steel. This would include, for example, stainless steel or cold rolled steel. In some examples, the retainer can be constructed from 14 gauge cold rolled steel.

The height 733 of the central elongate portion of the retainer 225 depends upon the thickness of the glass panel 112. In some examples, the height can be at least about 0.25 inches. In some examples, the height can be less than about 1.0 inches.

The present disclosure further provides a method of constructing a fire-rated elevator door 101. The elevator door 101 includes a face panel 102 framing a void 501, a liner 204 framing a void 601, a fire-rated glass panel 112, and one or more retainers 225 and 235. The method includes aligning the face panel void 501 with the liner void 601 to form a door frame 121 and fastening the face panel 102 to the liner 204. Then a first bonding tape 362 is applied either to the hoistway-facing surface 504 of the face panel 102 or to the corridor-facing surface 114 of the glass panel 112. After the step of applying the first bonding tape, the glass panel 112 is inserted through the liner void 601 and into an interior of the door frame 121. The hoistway-facing surface 504 of the face panel 102 is bonded to the corridor-facing surface 114 of the glass panel 112 such that the glass panel 112 protrudes beyond a hoistway-facing side 206 of the door core 351.

A second bonding tape 362 is applied to either a hoistway-facing surface 214 of the glass panel 112 or to a glass-facing surface 726 of a retainer 225, and then the hoistway-facing surface 214 of the glass panel 112 is bonded to the glass-facing surface 726 of the retainer 225. The liner-facing surface 722 of the retainer 225 is fastened to a hoistway-facing surface 604 of the liner 204.

Optionally, in some examples the method includes inserting a spacing assembly 331 or 333 between the face panel 102 and the liner 204 and inserting multiple setting blocks 334 around an outside perimeter 313 of the glass panel 112 between the glass panel 112 and the spacing assembly 331 or 333. Optionally, the method further includes fastening the face panel 102 to the liner 204 by welding with welds spaced no more than 6 inches apart. Optionally, the method further includes fastening the retainer 225 and the liner 204 with multiple fasteners spaced no more than 6 inches apart. In some examples, the method includes fixing the retainer 225 to the liner 204 with a fastener 251.

It should be noted that, as used in this specification and the appended claims, the singular forms include the plural unless the context clearly dictates otherwise. It should also be noted that the term "or" is generally employed in its sense including "and/or" unless the content clearly dictates otherwise.

All publications and patent applications referenced in this specification are herein incorporated by reference in their entirety.

The invention has been described with reference to various specific and preferred embodiments and techniques. However, it should be understood that many variations and modifications may be made while remaining within the spirit and scope of the invention.

What is claimed is:

1. An elevator hoistway door comprising:

a face panel framing a void;

a liner framing a void, wherein the face panel and the liner define a door core thickness;

a fire-rated glass panel having a thickness that is greater than the door core thickness, the glass panel having a hoistway-facing surface;

one or more retainers secured to the hoistway-facing surface of the glass panel and to a hoistway-facing surface of the liner.

2. The door of claim 1, wherein the one or more retainers each comprise an elongated member with a central elongate portion having a first elongate perpendicular extension from a first end of the central elongate portion and a second elongate perpendicular extension from a second end of the central elongate portion.

3. The door of claim 1, wherein a corridor-facing surface of the glass panel is bonded to a hoistway-facing surface of the face panel with a bonding tape.

4. The door of claim 1, wherein the glass panel has at least a 90-minute fire rating.

5. The door of claim 1, wherein the glass panel sits proud of the liner on a hoistway-facing side of the elevator door.

6. The door of claim 1, wherein the liner void is larger than the face panel void.

7. The door of claim 1, further comprising a retainer clip attached to a vertical portion of the elevator door.

8. The door of claim 1, wherein the one or more retainers are bonded to the hoistway-facing surface of the glass panel with a double-sided bonding tape.

9. The door of claim 1, wherein the one or more retainers are fixed to the liner with a fastener.

10. The door of claim 1 further comprising one or more setting blocks around an outside perimeter of the glass panel, wherein the setting blocks comprise a non-combustible material.

11. The door of claim 1, further comprising one or more setting blocks around an outside perimeter of the glass panel, wherein the setting blocks comprise a material from the group consisting of wood, calcium silicate and fiberglass.

12. The door of claim 1, wherein the door is a single-speed side opening door.

13. The door of claim 1, wherein the door is a single-speed center opening door.

14. The door of claim 1, wherein the one or more retainers comprises two horizontal retainers and two vertical retainers.

15. The door of claim 1, wherein there is no air gap in a glass portion of the door.

16. A method of constructing a fire-rated elevator door including a face panel framing a void, a liner framing a void, a fire-rated glass panel, and one or more retainers, the method comprising:

aligning the face panel void with the liner void to form a door frame;

fastening the face panel to the liner;

applying a first bonding tape to a hoistway-facing surface of the face panel or to a corridor-facing surface of the glass panel;

after the step of applying the first bonding tape, inserting the glass panel through the liner void and into an interior of the door frame;

bonding the hoistway-facing surface of the face panel to the corridor-facing surface of the glass panel, wherein the glass panel protrudes beyond a hoistway-facing side of a door core of the elevator door, wherein the face panel and the liner define a door core thickness and the fire-rated glass panel has a thickness that is greater than the door core thickness;

applying a second bonding tape to a hoistway-facing surface of the glass panel or to a glass-facing surface of a retainer;

bonding the hoistway-facing surface of the glass panel to the glass-facing surface of the retainer; and fastening a liner-facing surface of the retainer to a hoistway-facing surface of the liner.

17. The method of claim 16, further comprising the steps of:

inserting a spacing assembly between the face panel and the liner, and inserting a plurality of setting blocks around an outside perimeter of the glass panel between the glass panel and the spacing assembly.

18. The method of claim 16, wherein the face panel and liner are fastened by welding with welds spaced no more than 6 inches apart.

19. The method of claim 16, wherein the retainer and liner are fastened with a plurality of fasteners spaced no more than 6 inches apart.

20. The method of claim 16, wherein the retainer is fixed to the liner with a plurality of fasteners.

* * * * *